US007731331B2

(12) United States Patent
Karrer et al.

(10) Patent No.: US 7,731,331 B2
(45) Date of Patent: Jun. 8, 2010

(54) METHOD AND DEVICE FOR INK-JET PRINTING A MOVING WEB

(75) Inventors: Andreas Karrer, Satteldorf (DE); Luca Minutillo, Montesilvano (IT); Piero Sabbi, Pescara (IT); Osvaldo Mancini, Pescara (IT); Simon Holt, Crailsheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 22 days.

(21) Appl. No.: 12/146,750

(22) Filed: Jun. 26, 2008

(65) Prior Publication Data

US 2009/0033716 A1 Feb. 5, 2009

(30) Foreign Application Priority Data

Jul. 30, 2007 (EP) ..... 07014889

(51) Int. Cl.
*B41J 23/00* (2006.01)
*B41J 25/308* (2006.01)

(52) U.S. Cl. ..... 347/37; 347/8

(58) Field of Classification Search ..... 347/4, 347/8, 37, 41, 101, 104, 105, 5, 16
See application file for complete search history.

(56) References Cited

U.S. PATENT DOCUMENTS 6,050,675 A * 4/2000 Bartolome ..... 347/41
6,644,801 B2 * 11/2003 Matsui et al. ..... 347/104
6,997,550 B2 * 2/2006 Uchisako et al. ..... 347/104

FOREIGN PATENT DOCUMENTS

WO WO 97/48634 A1 12/1997

* cited by examiner

*Primary Examiner*—Hai C Pham
(74) *Attorney, Agent, or Firm*—David M. Weirich; Brian M. Bolam

(57) ABSTRACT

A device for printing a web moving in a direction ($Y_B$), wherein ink jets print on the web a printing width across its direction ($Y_B$) of advancement while traversing a printing station. The printing station includes one or more printer heads that produce ink jets over a footprint width which is narrower than the intended printing width over the web. One or more shaping elements bestow on the web traversing the printing station a V-shape so that the web is at least locally oriented oblique to the linear array of nozzles that project the ink. The ink from the printer head(s) is thus printed over the intended printing width of the web.

15 Claims, 2 Drawing Sheets

METHOD AND DEVICE FOR INK-JET PRINTING A MOVING WEB

FIELD OF INVENTION

The invention relates to inkjet printing (i.e. printing by means of ink jets) of moving webs. A possible field of application of the invention is inkjet printing webs of materials included in sanitary products. Film materials as used in producing so-called topsheets or secondary topsheets for sanitary products are exemplary of these materials.

BACKGROUND OF INVENTION

PCT application WO-A-97/48634 discloses a device for printing a moving substrate web by means of inkjets and comprising means for moving the substrate web, a printing station with several inkjet nozzles arranged over curved trajectories past which the substrate web can be moved and in which the substrate web can be printed. Bending means are fitted in the region of the printing station for printing the substrate web which is fed to the apparatus in a flat state, substantially parallel to its lengthwise direction, so that in the region of the printing station the cross action of the substrate web is a curved shape.

Moving webs as considered in the foregoing usually exhibit a width to be printed which is in excess of the width of the strip ("footprint") which can be simultaneously printed by the ink-jets included in a conventional printer head.

Using multiple heads arranged side-by-side may permit to increase the ink-jet footprint to print a moving web over a width in excess of the footprint of a single printer head. Using multiple heads arranged side-by-side would however be disadvantageous in terms of costs, reduced efficiency and increase the complexity of the associated machinery.

It would be desirable to provide an improved method and a corresponding device, for performing ink-jet printing of a web over a broader range of widths, which is simpler and cost effective.

SUMMARY OF INVENTION

The present invention provides a method for ink-jet printing a web moving in a direction and travelling through a printing station to be printed over a printing width across this direction by ink-jets projected from a linear array of nozzles over a footprint width narrower than the printing width.

In an embodiment, ink from the ink-jets projected over the footprint width can be printed over the printing width of the web due to the web being at least locally oriented oblique (i.e. slant) to the linear array of nozzles that project the ink. In certain embodiments of the invention, this result can be achieved by bending the web at the printing station to a channel-like shape (e.g. a V-shape).

The invention also relates to a corresponding device.

BRIEF DESCRIPTION OF THE DRAWINGS

Exemplary embodiments of the invention will now be described, purely by way of non-limiting example, with reference to the annexed representations, wherein.

DETAILED DESCRIPTION OF THE INVENTION

Figure 1:
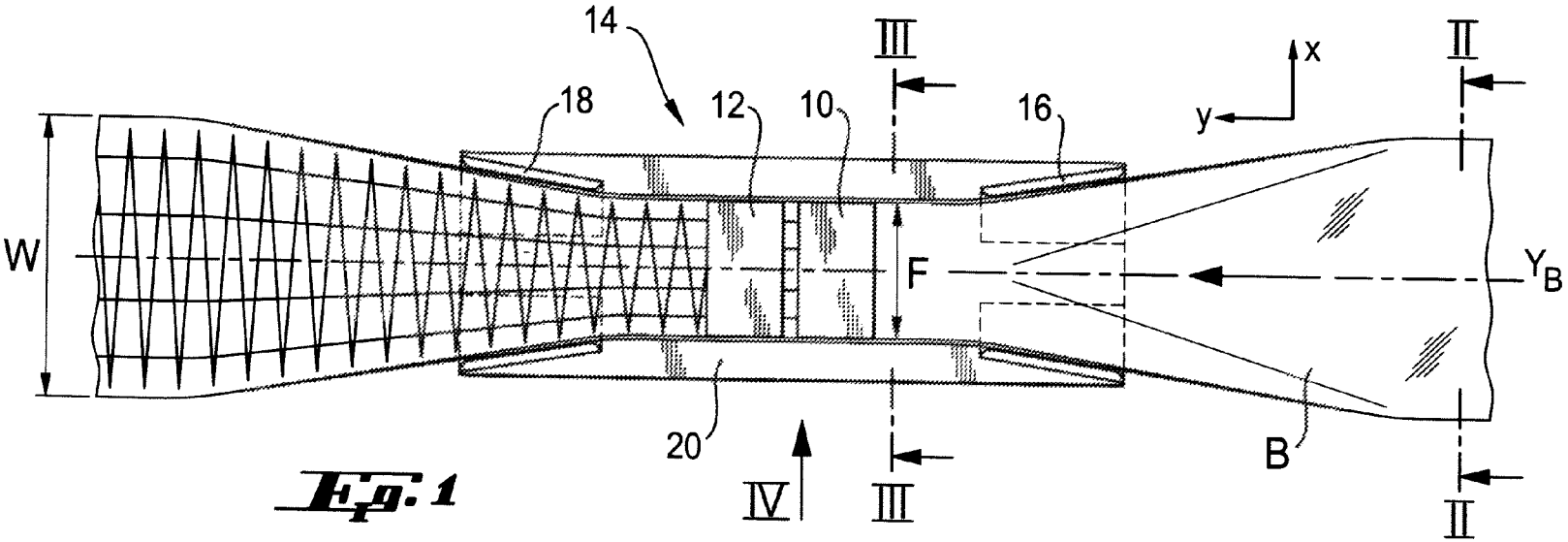
FIG. 1 is a plan view of an ink-jet printing arrangement as described herein.

In FIG. 1, reference B generally denotes a laminar web moving lengthwise in the direction of a main axis $Y_B$. In the embodiment shown, the axis $Y_B$ is the principal axis of the web; the web B moves from right to left with reference to the viewpoint of FIG. 1.

In an embodiment, the web B may be a web for use in producing sanitary products such as sanitary napkins, diapers, adult incontinence products or the like. In an embodiment, the web B may be a secondary topsheet (STS) having an overall width of e.g. 90 mm.

The moving web B is ink-jet printed over a width W across the axis $Y_B$, namely the direction of movement of the web B.

In the embodiment shown herein, the width W to be printed substantially corresponds to the whole width of the web B, namely the distance separating the opposite longitudinal edges thereof. The width W to be printed may be narrower than the whole width of the web B. The width to be printed may be located centrally or laterally offset with respect to the central main axis $Y_B$ of the web B. While the width W is shown here as intended to be printed continuously and across its whole extension, the arrangement described herein can be easily applied to printing the width W intermittently and/or in a strip-like fashion, so that the resulting printing on the web may correspond to any kind of pattern/image.

Printing may be effected by a stationary ink-jet printer head 10 including a linear array of nozzles that project ink-jets onto the web B in correspondence with a printing station 14.

The exemplary embodiment illustrated in FIG. 1 adopts a tandem arrangement of two stationary printer heads 10, 12 cascaded (i.e. staggered) along the direction $Y_B$ of movement of the web B. The "footprint" (i.e. the width across the axis $Y_B$ over which ink-jets are projected by the rectilinear array of nozzles of the printer head 10) will in fact coincide with the footprint of the printer head 12. In this tandem arrangement, one printer head at a time may be operative while the other may be at stand by (e.g. for cleaning purposes). Using plural (i.e. two or more) printer heads having substantially identical footprints cascaded along the direction of advancement of the web B may permit multi-colour printing by feeding the various printer heads with inks of different colours. Individual printer heads capable of providing multi-colour printing may also be used.

One printer head (namely head 10) will be primarily referred to throughout this description with the proviso that what is stated in connection with that printer head will generally apply also to the other printer head.

Reference numerals 16 and 18 designate two elements ("boards") in the form of plates arranged upstream and downstream the printing station 14. The expressions "upstream" and "downstream" refer to the directions of the web B, which is from right to left in the representation of FIG. 1.

In an embodiment, the plates comprising the boards 16, 18 may be V-shaped. These plates may also have a different shape; a V-shape will be considered in the following for ease of representation.

Figure 2:
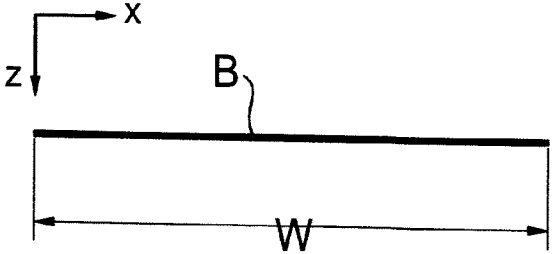
FIG. 2 is a cross-sectional view along line II-II' of FIG. 1.
Figure 4:
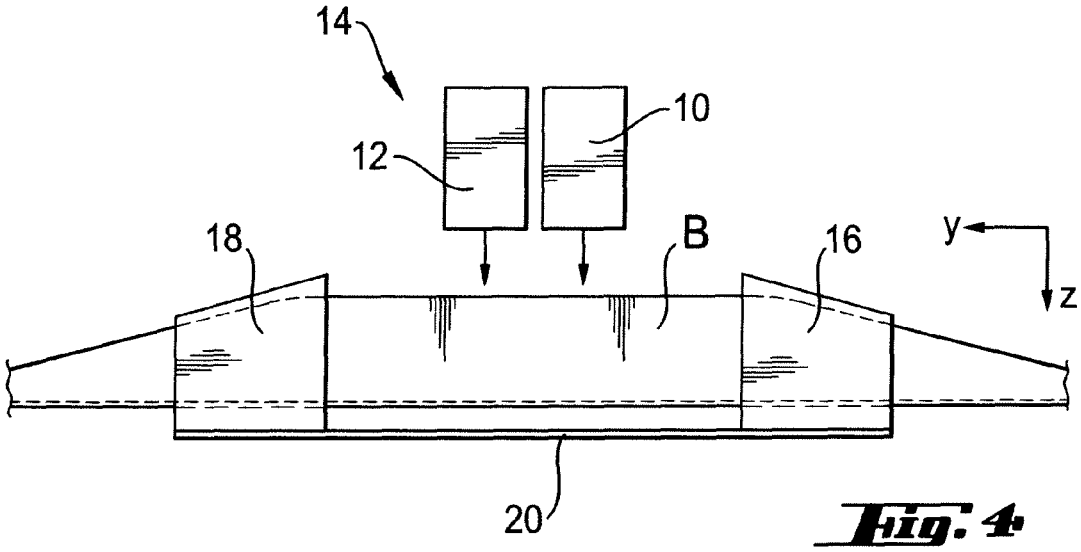
FIG. 4 is a side elevational view of the portion of the device indicated by the arrow IV in FIG. 1.

The web B is advanced towards the printing station 14 in a flat condition as schematically shown in the cross-sectional view of FIG. 2. As a result of passing through the "upstream" board 16, the web B is imparted a channel-like shape. In an embodiment as schematically represented in the cross-sectional view of FIG. 3, the channel-like shape may be a V-shape.

The opening angle of the V-shape—designated 2α (alpha)—is determined by the opening angle of the shaper element which may be essentially a V-shape plate or board. The angle 2α is selected in such a way that the open portion (the "mouth" portion) of the channel-like shape has a width equal or larger than the footprint F (see FIG. 3) of the printer head 10, namely the width F over which ink-jets are ejected from the printer head 10.

Again, the width W to be printed may be narrower than the whole edge-to-edge width of the web B. In that case, only the portion of the web corresponding to the width W to be printed need be imparted a channel-like shape as described herein. Similarly, while a symmetrical channel-like shape is considered herein, a non-symmetrical shape (i.e. a V-shape with arms of different lengths) or any other geometry may be equally applied in the arrangement described herein.

In any case, while being ejected over a footprint F which is narrower than the width W of the web B to be printed, the ink from the printer head 10 will be able to reach (and thus "print") the whole width W to be printed due to the web being at least locally oriented oblique (i.e. slant) to the linear array of nozzles that project the ink. Due to this oblique orientation, the width of the web to be printed will in fact be "seen" by the printer head (and the ink jets projected therefrom) as having a width narrower than its actual width.

Figure 3:
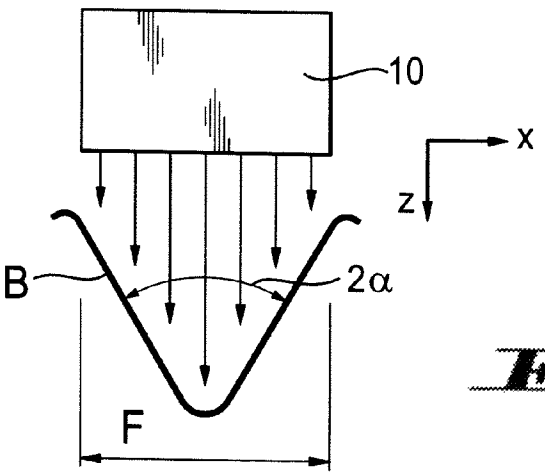
FIG. 3 is a cross-sectional view along line III-III' of FIG. 1 reproduced in a slightly enlarged scale.

In the embodiment shown, where the web B is bent to a V-shape, both sides of the V-shape will represent portions of the web W which are at an oblique orientation (with opposite angles) to the linear array of nozzles that project the ink. FIG. 3 shows that—for a given footprint F—the width W of the portion of the web onto which ink is projected from the printer head 10 can be selectively varied by correspondingly varying the amplitude of the angle α (2α). The image printed onto the web B will be generally distorted in comparison with the image that would be printed on the web if the web B were exposed to the printer head 10 in a flat condition. This is due i.a. to the fact that, in order to reach the moving web B being printed, the ink droplets of those ink jets that are ejected in correspondence with that part or parts of the web W which is/are farther from the printer head due to the oblique orientation of the web (e.g., in the embodiment shown, those ink jets that are ejected from the middle portion of the printer head) will have to travel a longer distance in comparison to the ink droplets of those ink jets ejected from the printer head 10 in correspondence with that part or parts of the web W which is/are closer to the printer head due to the oblique orientation of the web (e.g., in the embodiment shown, those ink jets that are ejected at the ends of the footprint).

Means for compensating such a distortion, which is also dependent on the linear speed of the web B along the axis $Y_B$ will be discussed in the following.

In an embodiment, a printer head with a footprint F of e.g. 50 mm may be used to print a width W equal to approximately 60 mm by selecting a equal to 36.8 degrees.

After printing, the web B is advanced towards the "downstream" board 18 and is restored to a flat condition for further processing such as e.g. winding in a roll or possible direct feeding to production apparatus.

Undesired contamination of the web and/or the board(s) may derive e.g. from web fibres sticking to the boards 16, 18 to be mixed with ink to form an undesired "blob" of appreciable thickness (e.g. 3 mm).

In the arrangement illustrated, the two boards 16 and 18 may be kept at a distance to each other so that when travelling through the printing station 14 to receive inkjet printing the V-shaped web B is not supported. In that way, ink projected from the printer head(s) is unable to reach either of the boards 16 and 18 before becoming dry and is thus unsuitable to contaminate the boards.

In an embodiment, the "upstream" board 16 can be kept at a distance of at least about 60 mm to the printing area where ink is projected.

In an embodiment, the "downstream" board 18 was maintained at a distance of at least about 100 mm to the printing area. These different clearance values take into account the advancement of the web B, so that the "upstream" board may be kept closer to the printing area than the "downstream" board.

It will be appreciated that, in the case of an arrangement including two (or more) printer heads cascaded along the direction of advancement of the web B, ensuring a given minimum clearance between the "upstream" board 16 and the first printer head (i.e. head 10 in FIG. 1) in the cascaded arrangement will automatically ensure that higher clearances are achieved for the other printer heads. Similarly, ensuring a given minimum clearance between the last printer head (i.e. head 12 in FIG. 1) in the cascaded arrangement will automatically ensure that higher clearances are achieved for the other printer heads.

Contamination of the printer head(s) may produced by dust possibly generated by the web B due to friction against the boards 16 and 18. This contamination is presumably related to turbulence generated around the moving web, this turbulence being likely to take web dust and/or ink back against the printer head.

To prevent this, a baffle 20 (such as a flat board) is provided underneath the web W extending like a bridge between the boards 16, 18. The baffle 20 is effective in blocking stray ink particles and preventing them from migrating back to the printer head(s) as a result of turbulence. The blocking effect of ink of the baffle 20 is also effective against web dust contamination in that the web dust is no longer in a position to mix with the stray ink droplets to form a sticky mass which may adhere to the printer head.

Criteria for correcting distortion due to printing being effected onto a moving web which is V-shaped will now be discussed with reference to FIG. 5. As indicated, this distortion is primarily due to the fact that two ink droplets ejected at the same time by the printer head may in fact have different lengths to travel in reaching the web depending on the position (central-lateral) of the respective ink jets within the footprint F. These different path lengths will translate into two different time instants at which these two ink droplets will reach the web B to become printed thereon. During the time interval between those two different time instants the web will travel a given length along the axis $Y_B$, this resulting in a length of distortion in the matter printed.

Figure 5:
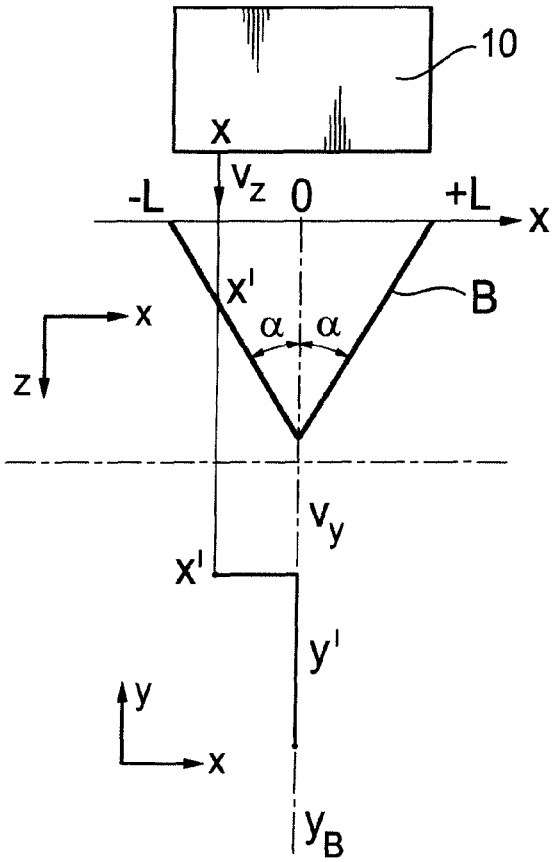
FIG. 5 is a schematic diagram representative of certain geometrical entities discussed herein.

In FIG. 5, the reference numeral 10 again denotes a printer head configured to project ink droplets over a "footprint" F extending along an x axis (cross-wise the web axis $Y_B$) between −L and L, the footprint having thus a width equal to 2L. The (vertex) angle of the V-shape to which the web B is folded is denoted 2α.

The following definitions apply:

$v_z$ is the speed of an ink droplet projected along a z axis from the printer head 10 towards the web B;

$v_y$ is the speed of the web B along the axis $Y_B$;

x is the position of an ink droplet on the printer head varying from −L to L;

x' is the position of an ink droplet on the web B after being applied (printed) thereon; and y is the length of distortion of the web due to the possible different travel paths/times of ink droplets eject at different point in the footprint.

Under usual operating conditions, the following assumptions will apply:

the influence of gravity on the speed of ink droplets can be neglected: the time of travel between the printer head 10 and the web B is in fact very short;

the influence of air friction on the speed of the ink droplets can be similarly neglected in view of the small dimensions of the droplets;

the (otherwise small) distance of the printer head from the closest edge of the web can be in fact neglected since this travel path is identical for all the droplets and does not produce any distortion in the image printed on the web B;

finally, the droplets can be regarded as forming continuous lines rather than individual points and the symmetry of the system may permit to simplify the geometry of FIG. 5 to just one half of the web W.

Given a droplet at the position (x, 0) on the head 10 at the time $t_0$, this droplet will print on the (flat) web B at a position (x', y) at a time t when the drop reaches the web.

In general, $x'=x/\sin\alpha$ can be easily calculated from a trigonometric point of view once $\alpha$ is known.

If z denotes the axis identificative of the direction of travel of the droplets from the head 10 to the web B, one has:

$$dz=dx/\tan\alpha \text{ and } dz=v_z dt$$

so that $$dt=dx/(v_z\cdot\tan\alpha)$$

$$dy=-v_y dt \text{ so that } dt=-dy/v_y$$

By means of extrapolation one has:

$$dy=-v_y dx/(v_z\tan\alpha)=-Kdx.$$

Consequently, by solving the integral $$y-y_L=y=\int Kdx-K(L-x),$$

where the integral extends between x and L, one obtains the equation of the distortion in the y direction.

In the geometry of the present embodiment this is a linear function with a slope −K, where K is a constant depending on the speed of the web, the speed of the droplets and the geometry of the system, i.e. the angle ($\alpha$) of said moving web is at least locally oriented oblique to the linear array of nozzles.

Consequently the formulas above make it possible to very easily predict image distortion and produce a model to generate the image to be loaded in the printer 10 suitably deformed to obtain the desired printed pattern (e.g. an image) on the web B.

In the arrangement shown, the ink-jets from the printer head(s) may be projected onto the web B through the open portion of the channel-like shape (see FIG. 3) thus printing the "inner" surface of the channel-like shaped web B. The ink-jets could be similarly projected onto the web B by acting on the "outer" surface of the channel-like shaped web, namely with an arrangement complementary to that shown FIG. 3.

Of course, without prejudice to the underlying principles of the invention, the details and embodiments may vary, even significantly, with respect to what has been described by way of example only, without departing from the scope of the invention as defined by the annexed claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that is alone, or in any combination with any other reference or references, teaches, suggests or discloses any such invention. Further, to the extend that any meaning or definition of term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for ink jet printing a web moving in a direction ($Y_B$) wherein the web travels through a printing station to be printed over a printing width across the direction ($Y_B$) by ink jets projected from a linear array of nozzles over a footprint width narrower than the printing width, wherein the web is at least locally oriented oblique to the linear array of nozzles that project the ink, whereby ink from the ink-jets projected over the footprint width is printed over the printing width of the web.

2. The method of claim 1, wherein the web is bent at the printing station to a channel-like shape.

3. The method of claim 2, wherein the channel-like shape is a V-shape.

4. The method of claim 2, including the step of projecting the ink-jets through the open portion of the channel-like shape to print the inner surface of the web bent to the channel-like shape.

5. The method of claim 1, wherein the moving web travels unsupported through the printing station.

6. The method of claim 1, including the step of masking with a baffle the side of the web opposite to the ink-jets at the printing station.

7. The method of claim 1, including the step of correcting a pattern printed by the ink-jets to compensate for distortion due to the moving web being at least locally oriented oblique to the linear array of nozzles that project the ink.

8. The method of claim 7, including the step of correcting the pattern as a function of the speed of movement of the web in the direction ($Y_B$), the speed of the droplets of the ink-jets and the angle the moving web is at least locally oriented oblique to the linear array of nozzles.

9. A device for ink-jet printing a web moving in a direction ($Y_B$) wherein the web is printed over a printing width across the direction ($Y_B$), the device including:

a printing station to be traversed by the web to be printed, the printing station including at least one printer head with a linear array of nozzles producing ink-jets over a footprint width narrower than the printing width, and at least one element to at least locally orient the web oblique to the linear array of nozzles that project the ink whereby ink from the ink-jets projected over the footprint width is printed over the printing width of the web.

10. The device of claim 9, including at least one shaping element to bend the web at the printing station to a channel-like shape.

11. The device of claim 10, wherein the channel-like shape is a V-shape.

12. The device of claim 9, including elements to support the web upstream and downstream the printing station with respect to the direction of travel of the moving web, whereby the moving web travels unsupported through the printing station.

13. The device of claim 9, including an element to support the web upstream of the printing station, whereby the upstream support element is arranged at least about 60 mm upstream the ink-jets.

14. The device of claim 9, including an element to support the web downstream of the printing station, whereby the downstream support element is arranged at least about 100 mm downstream the ink-jets.

15. The device of claim 9, including a baffle extending between the elements upstream and downstream the printing station, the baffle arranged on the side of the web opposite the at least one printer head.

* * * * *